United States Patent [19]

Grecksch et al.

[11] Patent Number: 5,056,726

[45] Date of Patent: Oct. 15, 1991

[54] YARN END LOOSENING APPARATUS FOR A TEXTILE WINDING MACHINE

[75] Inventors: Hans Grecksch; Dietmar Engelhardt, both of Monchengladbach, Fed. Rep. of Germany

[73] Assignee: W. Schlafhorst & Co., Monchen-Gladbach, Fed. Rep. of Germany

[21] Appl. No.: 457,101

[22] Filed: Dec. 26, 1989

[30] Foreign Application Priority Data

Dec. 23, 1988 [DE] Fed. Rep. of Germany ..... 3843553

[51] Int. Cl.[5] ..... B65H 67/06; B65H 67/08

[52] U.S. Cl. ..... 242/35.5 A; 242/35.6 E

[58] Field of Search ..... 242/35.5 R, 35.5 A, 242/35.6 R, 35.6 E, 18 R

[56] References Cited

U.S. PATENT DOCUMENTS

| | | | |
|---|---|---|---|
| 3,236,464 | 2/1966 | Wey | 242/35.6 E X |
| 4,463,909 | 8/1984 | Kiriake et al. | 242/35.5 A |
| 4,601,434 | 7/1986 | Mori et al. | 242/35.5 A |
| 4,901,931 | 2/1990 | Mista | 242/35.6 E |
| 4,911,371 | 3/1990 | Mista | 242/35.6 E |
| 4,921,179 | 5/1990 | Surkamp et al. | 242/35.6 E |

*Primary Examiner*—Stanley N. Gilreath
*Attorney, Agent, or Firm*—Shefte, Pinckney & Sawyer

[57] ABSTRACT

A yarn end loosening apparatus for a textile machine includes first and second chamber portions which are positionable to form a gas guide chamber for directing jet streams of gas against the yarn package therein to effect loosening of a yarn end. A movement device selectively moves the first chamber portion between the chamber 4 main position in which it forms a gas guide chamber with the second chamber portion, a clearance position in which it permits a tube support member which supports a yarn package to travel away from the winding station of the textile machine and a travel blocking position in which a following tube support member which supports a fresh yarn package is prevented from traveling beyond the unwinding location at which the yarn package is unwound. Another movement device is also provided for moving the second chamber portion to separate each tube support member from a subsequently following tube support member. The chamber movement devices include vertical shafts on which the chamber portions are mounted for pivoting of the chamber portions about vertical axes.

13 Claims, 9 Drawing Sheets

FIG. 2
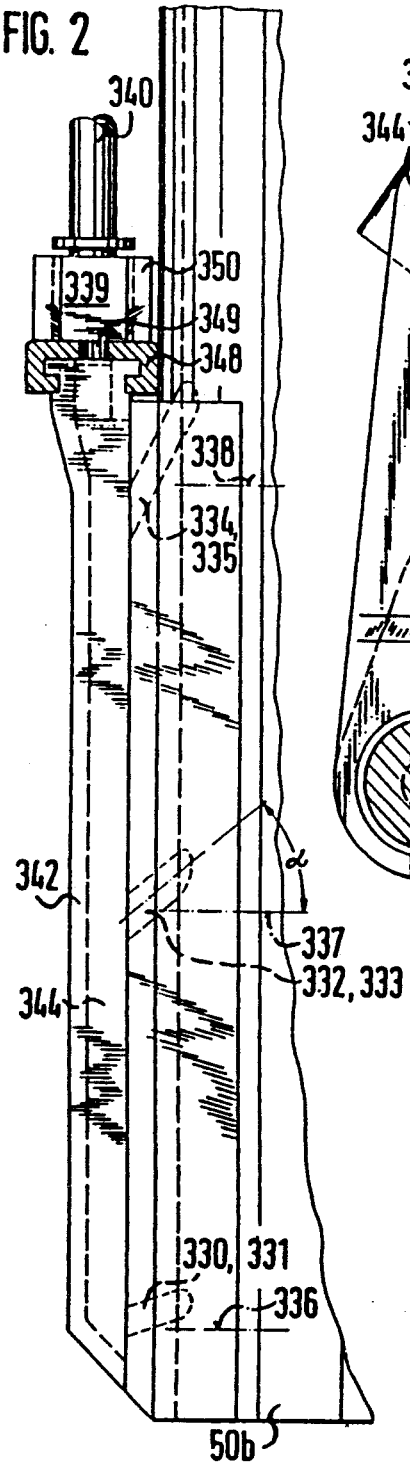
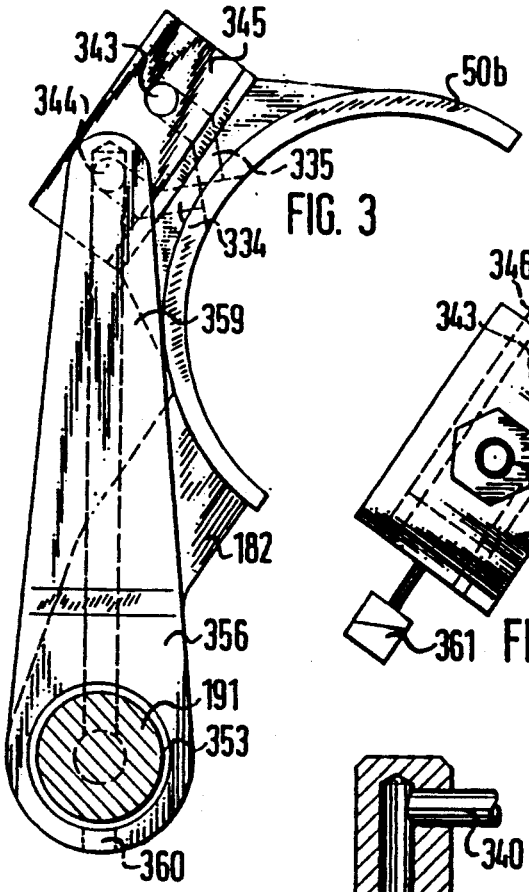
FIG. 3
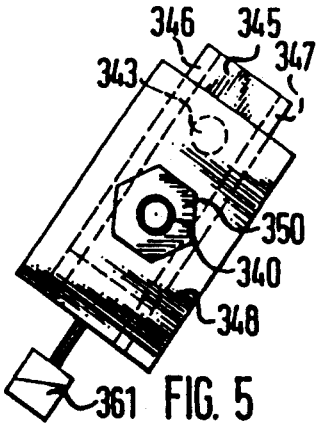
FIG. 5
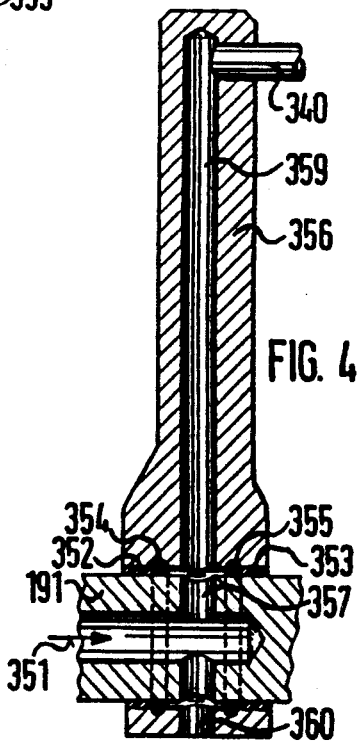
FIG. 4

YARN END LOOSENING APPARATUS FOR A TEXTILE WINDING MACHINE

BACKGROUND OF THE INVENTION

The present invention relates to a yarn end loosening apparatus for a textile winding machine and, more particularly, a yarn end loosening apparatus for loosening the yarn end of a yarn package built on a tube which is individually supported on a tube support member.

It is known to provide a textile winding machine with a plurality of independently movable tube support members and to transfer yarn packages comprising yarn built on tubes from a yarn package storage location onto the tube support members. The tube support members typically include an upright member for receiving a tube inserted thereon to support the tube in a generally upright disposition. The tube support members are typically moved in a path which initially leads to a yarn end preparation machine which loosens the yarn end of each package, without regard to the location of the yarn end on the package, and disposes the yarn end in a preferred preliminary position such as, for example, in a bottom winding around the bottom portion of the tube. From there, the tube support members are transported to a winding station in which the yarn packages are unwound from the tubes. Following the winding station, the tube support members, with empty tubes supported thereon, are transported to a tube removal location for removing the empty tubes. Those tube support members from which a tube has been removed are then returned to the tube transfer location for the insertion of a new yarn package thereon.

However, sometimes tube support members are transported to the unwinding location having yarn packages thereon which have not undergone the process of disposing the yarn end of the package in a preferred preliminary disposition. In this situation, a yarn end may be located at any one of an infinite number of random locations on the yarn package. To initiate the unwinding process, the yarn end must first be loosened from the yarn package and guided to an appropriate yarn draw-off component of the winding machine. Accordingly, the need exists for an apparatus which efficiently and reliably loosens a yarn end of a yarn package for engagement of the yarn end by the yarn draw-off component of the winding station, if the yarn end has not initially been disposed in a preferred preliminary disposition with respect to the yarn package.

SUMMARY OF THE INVENTION

The present invention provides a yarn end loosening apparatus which efficiently and reliably loosens the yarn end of a yarn package built on a tube which is supported on an independently movable tube support member without regard to the location of the yarn end relative to the yarn package.

Briefly described, the present invention provides a yarn end loosening apparatus for a textile machine of the type having a plurality of independently movable tube support members for individually supporting tubes in generally upright dispositions, an unwinding device for unwinding, at an unwinding location, packages of textile material such as yarn or the like which is wound on tubes supported on the tube support members, a delivery assembly for delivering the tube support members to a preliminary location for feeding to the unwinding device, a discharge assembly for transporting tube support members from a discharge location to a further handling location, and a cross-transport assembly for transporting the tube support members along a cross path extending from the preliminary location through the unwinding location to the discharge location. The yarn end loosening apparatus includes a first chamber portion, a second chamber portion, the first and second chamber portions being positionable to combine to form a gas guide chamber and having jet nozzles for directing jet streams of gas into the chamber against a yarn package therein to loosen a yarn end thereof, first movement means connected to the first chamber portion for selectively moving the first chamber portion between a chamber forming position at the unwinding location in which the first chamber portion and the second chamber portion form the gas guide chamber for guiding gas relative to a yarn package supported by a respective tube support member at the unwinding location, a clearance position for permitting the respective tube support member to be moved from the unwinding location by the cross-transport assembly and a travel blocking position to block travel of the tube support member following the respective tube support member beyond the unwinding location, and second movement means connected to the second chamber portion for selectively moving the second chamber portion between the chamber forming position and a clearance position spaced from the cross path for permitting travel of a tube support member therepast along the cross path.

The second movement means moves the second chamber portion from its respective clearance position to the chamber forming position in correspondence with the movement of the following tube support member to the unwinding location to separate the following tube support member from a subsequently following tube support member.

According to one aspect of the present invention, the jet nozzles comprise a plurality of jet nozzles mounted to the first and second chamber portions for directing jet streams of gas interiorly of the gas guide chamber in inclined tangential directions with respect to a package supported by the respective tube support member at the unwinding location toward an end of the package to thereby loosen the end of the package. The yarn end loosening apparatus preferably also includes valve means for regulating the supply of gas to the jet nozzles.

According to one aspect of the present invention, the first movement means includes a first vertical shaft and means for pivotally coupling the first chamber portion to the first vertical shaft for pivoting thereabout, the second movement means includes a second vertical shaft and means for pivotally coupling the second chamber portion to the second vertical shaft for pivoting thereabout and means for pivoting the first and second chamber portions about the respective vertical shafts. The pivoting means preferably includes a first link member connected to the first chamber portion, a second link member connected to the second chamber portion and link drive means for driving the first and second link members.

According to another aspect of the present invention, the yarn end loosening apparatus jet nozzles comprise a first group of at least three jet nozzles axially displaced from one another, each jet nozzle being inclined at successively greater inclinations from the lowermost jet nozzle to the uppermost jet nozzle. The jet nozzles are preferably mounted in a selected one of the first and second chamber portions and are vertically aligned with one another.

In a further aspect of the present invention, the yarn loosening apparatus includes a second group of at least three jet nozzles, the jet nozzles of the first group direct jet streams of gas in a common first tangential direction and the jet nozzles of the second group direct jet streams of gas in a common second tangential direction different than the first common tangential direction and a reversing valve means for communicating a selected one of the first and second group of jet nozzles to a source of compressed gas. The first and second group of jet nozzles and the reversing valve member are mounted on a selected one of the first and second chamber portions.

In another aspect of the present invention, the gas guide chamber has an upper end formed with an upwardly inward taper.

BRIEF DESCRIPTION OF THE DRAWINGS

FIG. 2 is a vertical section of a portion of another embodiment of the yarn end loosening apparatus of the present invention;

FIG. 3 is a plan view of a portion of the another embodiment of yarn end loosening apparatus shown in FIG. 2;

FIG. 4 is a vertical sectional view of another portion of the another embodiment of the yarn end loosening apparatus shown in FIG. 2;

FIG. 5 is a plan view of a further portion of the another embodiment of the yarn end loosening apparatus shown in FIG. 2;

DETAILED DESCRIPTION OF THE PREFERRED EMBODIMENTS

Figure 1:
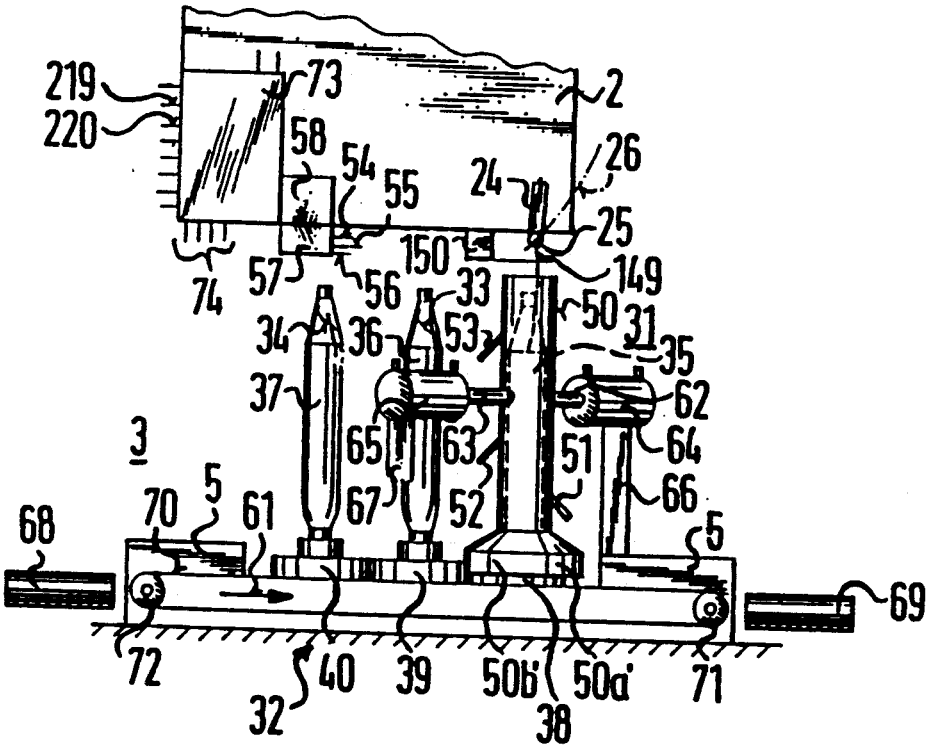
FIG. 1 is a side elevational view of a textile winding machine having a transport assembly for transporting independently movable tube support members to an unwinding location and embodying one embodiment of the yarn end loosening apparatus of the present invention.

In FIGS. 1, 6–10, 12 and 13, one embodiment of the yarn end loosening apparatus 31 of the present invention is illustrated. The winding station 2 includes a plurality of independently movable tube support members 38,39 and 40 for individually supporting a plurality of yarn packages 35,36 and 37, respectively, which comprise yarn built on an individual tube. Each yarn package 35–37 includes an upper reserve winding such as, for example, the upper reserve windings 33 and 34 on the yarn packages 36 and 37, respectively. As seen in FIG. 1, each tube support member 38,39,40, such as, for example, the tube support member 38, includes a cylindrical base plate 42, an intermediate plate 43 and a cylindrical upright component 45. The plates 42 and 43 and the upright cylindrical component 45 being coaxial. The upright component 45 has an outer diameter compatibly configured with respect to the inner diameter of the tubes onto which the yarn of the yarn packages 35–37 is built. Accordingly, the tube support members 38–40 individually support the yarn packages 35–37 in an upright disposition.

As seen in FIG. 1, the winding station 2 includes a conventional delivery assembly 68 having an endless belt for delivering the tube support members 38–40 to a preliminary location, a conventional discharge assembly 69 having an endless belt for transporting the tube support members 38–40 from a discharge location to a further handling location (not shown) and a cross-transport assembly 32 for transporting the tube support members 38–40 along a cross path extending from the preliminary location through an unwinding location to the discharge location. The cross-transport assembly 32 transports the tube support members 38–40, with the yarn packages 35–37 supported in upright dispositions thereon, to the unwinding location for individual unwinding of the yarn packages at the winding station 2.

The cross-transport assembly 32 includes an endless belt 70 trained around a pair of guide rollers 71,72 and driven by a conventional endless belt drive motor (not shown) in the direction indicated by the arrow 61 in FIG. 1. The junction of the delivery assembly 68 and the cross-transport assembly 32 defines the preliminary location. The tube support members 38–40 are transferred from the endless belt of the delivery assembly 68 to the endless belt 70 of the cross-transport assembly 32, at the preliminary location, in conventional manner. The junction of the endless belt of the discharge assembly 69 and the endless belt 70 of the cross-transport assembly 32 defines the discharge location. The tube support members 38–40 are transferred from the endless belt 70 of the cross-transport assembly 32 to the endless belt of the discharge assembly 69, at the discharge location, in conventional manner.

As seen in FIG. 1, the yarn end loosening apparatus 31 includes a support frame 5, a first support post 66 extending vertically from the support frame 5 and supporting a first movement means 64, a connector 62 and a first chamber portion 50*a* and a second support post 67 supporting a second movement means 65, a second connector 63 and a second chamber portion 50*b*. The first chamber portion 50*a* and the second chamber portion 50*b* form a gas guide chamber 50 when they are in mating contact with one another. The first movement means 64 and the second movement means 65 are each configured as a conventional hydraulic cylinder actuable to selectively retract and extend the respective associated connector 62 or 63, which are each configured as conventional hydraulic cylinder rods. The first movement means 64 and the second movement means 65 are each operatively connected by a plurality of conventional connectors 74 to a conventional central control unit 73 mounted to the winding station 2. The connector 74 can be, for example, flexible pneumatic conduits.

The first chamber portion 50*a* is fixedly connected to the free end of the connector 62. The second chamber portion 50*b* is fixedly connected to the free end of the connector 63. As seen in FIG. 1, the first chamber portion 50*a* and the second chamber portion 50*b* support a plurality of jet nozzles 51,52 and 53 which are operatively connected by a plurality of flexible conduits 54,55 and 56, respectively, to a conventional regulating valve 57. The regulating valve 57 regulates the outflow of compressed gas from a conventional compressed gas source 58 operatively connected to the central control unit 73. The jet nozzles 51,52 and 53 direct jet streams of gas, which are supplied via the conduits 54,55 and 56 from the compressed gas source 58, against a yarn package positioned between the first chamber portion 50*a* and the second chamber portion 50*b* to loosen a yarn end on the yarn package, as described in more detail below.

Figure 12:
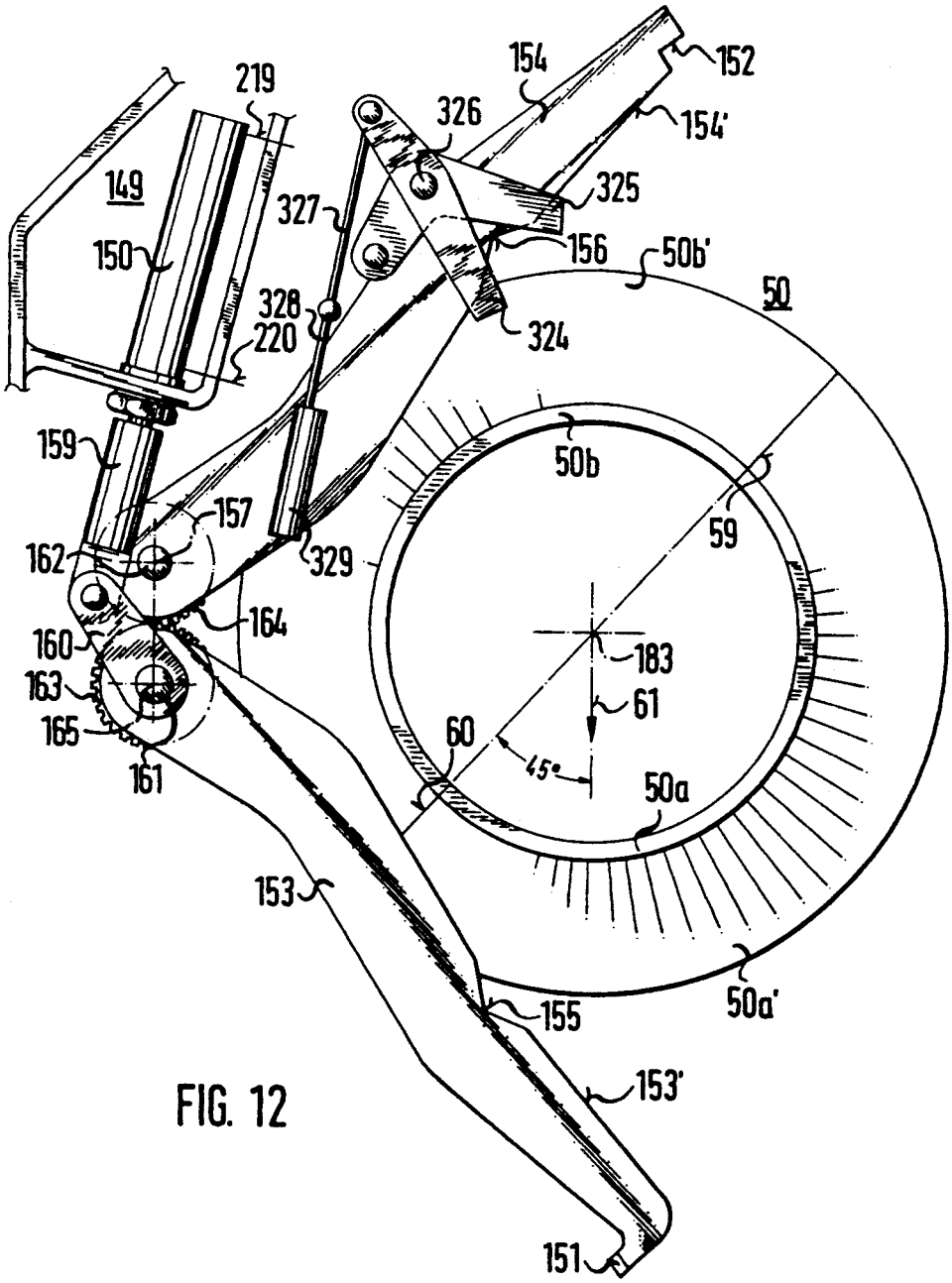
FIG. 12 is a plan view of a yarn loop opening component of the embodiment of the yarn end loosening apparatus shown in FIG. 1.

As seen in FIG. 12, the first chamber portion 50*a* and the second chamber portion 50*b* are respectively movable to a chamber forming position in which they define the gas guide chamber 50. In this regard, as seen in FIG. 1, the first chamber portion 50*a* includes a semi-cylindrical body portion having an axial extent greater than the length of any of the tubes supported on the tube support members 38,39,40 and an enlarged foot portion 50*a'* having a radial extent greater than the radial extent of the semi-cylindrical body portion. As seen in FIG. 1, the enlarged foot portion 50*a'* has a radial extent sufficient to accommodate the base plate 42 and the top plate 43 of a respective one of the tube support members 38,39,40 when the tube support member is positioned between the first chamber portion 50*a* and the second chamber portion 50*b* in the gas guide chamber 50.

The second chamber portion 50*b* includes a semi-cylindrical body portion and, as shown in FIG. 1, an enlarged foot portion 50*b'* having a radial extent greater than the radial extent of the semi-cylindrical portion. The radial extent of the enlarged foot portion 50*b'* is sufficient to accommodate the base plate 42 and the top plate 43 of a respective one of the tube support members 38,39,40 when the respective tube support member is positioned in the gas guide chamber 50.

The first chamber portion 50*a* and the second chamber portion 50*b* are compatibly configured with their respective semi-cylindrical body portions having the same radius and their respective enlarged foot portions 50*a'* and 50*b'* having the same cross sectional radial extent, such that the semi-cylindrical body portions and the enlarged foot portions, respectively, mate with one another along a first interface line 59 and a second interface line 60, as seen in FIG. 2, when the first chamber portion 50*a* and the second chamber portion 50*b* are moved into the chamber forming position to form the gas guide chamber 50. As seen in FIG. 1, the free end of the connector 62 is fixedly connected to the semi-cylindrical body portion of the first chamber portion 50*a* and the connector 63 is fixedly connected to the semi-cylindrical body portion of the second chamber portion 50*b* such that the semi-cylindrical body portions are supported in a vertical disposition. Thus, the gas guide chamber 50 includes a cylindrical portion, formed by the semi-cylindrical portions of the chamber portions 50*a*,50*b*, having an axis 183 (FIG. 12). As seen in FIG. 12, the first chamber portion 50*a* and the second chamber portion 50*b* are oriented relative to one another such that the first interface line 59 and the second interface line 60 define a line which intersects the direction of travel 61 at a 45 degree angle.

The winding station 2 includes a conventional yarn end receiving element having a suction tube 24 for applying a suction force through a suction intake mouth 25. The suction tube 24 is movable to move the suction intake mouth 25 along a circular arc 26. The yarn end receiving element is operable to receive a yarn end loosened from a yarn package at the unwinding location to convey the yarn end to a conventional splicing mechanism (not shown) for splicing with a yarn end of a yarn wound on a cross wound package (not shown) at the unwinding device 2 or for delivery to a yarn delivery component such as a conventional yarn splicing device (not shown) of the unwinding machine 2.

The yarn end loosening apparatus 31 operates as follows to loosen a yarn end of a yarn package supported on one of the tube support members 38,39,40 and to support the yarn package during subsequent unwinding of the yarn from the yarn package at the winding station 2. The tube support members 38,39,40, each supporting a tube having a yarn package built thereon such as, for example, the yarn packages 36,37 supported on the tube support members 39,40, respectively, are delivered by the delivery assembly 68 to the preliminary location for feeding to the unwinding device 2. In conventional manner, the tube support members 38,39,40 are loaded onto the endless belt of the cross-transport assembly 32 such that they are transported in the direction of travel 61 while arranged serially with respect to each other, as seen in FIG. 1.

As the tube support members 38,39,40 travel in the direction of travel 61 toward the unwinding location, the second chamber portion 50*b* is initially disposed in a clearance position in which it is sufficiently spaced from the cross path to permit the tube support members to be moved therepast by the cross-transport assembly 32. The second chamber portion 50*b* is disposed in its clearance position by appropriate control of the second movement means 65 by the central control unit 73. Specifically, the central control unit 73 controls the second movement means 65 to cause it to be charged with a conventional hydraulic fluid from a conventional hydraulic fluid source (not shown). The charging of the second movement means 65 with hydraulic fluid causes the connector 63 to be retracted into the second movement means 65, thereby displacing the second chamber portion 50*b* laterally toward the same side of the cross-transport assembly 70 as the side on which the second support post 67 is disposed to an extent sufficient for the cylindrical body portion and the enlarged foot portion 50*b'* to be clear of the cross path.

The first chamber portion 50*a* is initially disposed in the chamber forming position whereby it intersects the cross path. As seen in FIG. 2, the semi-cylindrical body portion and the enlarged foot portion 50*a'* of the first chamber portion 50*a* face in the direction opposite to the direction of travel 61.

The cross-transport assembly 32 eventually moves the forwardmost tube support member 38, as viewed in the direction of travel 61, past the second chamber portion 50*b*, which is disposed in its clearance position, and, further, into contact with the inner surface of the first chamber portion 50*a*. The base cylindrical plate 42 of the tube support member 38 contacts the enlarged foot portion 50*a'*, whereby further travel of the tube support member 38 in the direction of travel 61 is prevented. The tube support member 39, which is the next tube support member following the tube support member 38, has its base cylindrical plate 42 in contact with the base cylindrical plate 42 of the preceding tube support member 38 due to the continuous action of the endless belt of the cross-transport assembly 32.

The central control unit 73 then controls the second movement means 65 to extend the connector 63 to thereby effect movement of the second chamber portion 50*b* from its clearance position to the chamber forming position in which the second chamber portion 50*b* and the first chamber portion mate along the first engagement line 59 and second engagement line 60 with the yarn package supported on the tube support member 38 supported in upright disposition therebetween. The enlarged foot portion 50*b'* of the second chamber portion 50*b* displaces the tube support members 39 and 40 slightly in the direction opposite to the direction of travel 61 during the movement of the second chamber portion 50*b* from its clearance position to the chamber forming position. Accordingly, once the second chamber portion 50*b* is disposed in the chamber forming position, the enlarged foot portion 50*b'* extends between the respective cylindrical base plates 42 of the tube support member 38 and the tube support member 39 to thereby space the two tube support members from one another.

The gas guide chamber 50 formed by the first chamber portion 50*a* and the second chamber portion 50*b* provides a substantially sealed enclosure along the extent of the yarn package supported on the tube support member 38. Accordingly, once the second portion chamber 50*b* mates with the first chamber portion 50*a* to form the gas guide chamber 50, the central control unit 73 can control the regulating valve 57 to supply compressed gas to the jet nozzles 51,52 and 53. As seen in FIG. 1, the jet nozzles are oriented to direct jet streams of gas in inclined tangential directions with respect to the yarn package to loosen a yarn end of the yarn package.

The loosened yarn end is directed upwardly under the influence of a helical gas flow which occurs due to the orientation of the jet nozzles 51,52,53 and the cylindrical shape formed by the semi-cylindrical body portions of the first chamber portion 50*a* and the second chamber portion 50*b*. The helical flow of gas eventually lifts the loosened yarn end toward the top of the gas guide chamber 50 for engagement of the yarn end by the suction mouth of the suction device 24. Once the suction device 24 has grasped the loosened yarn end, the suction device 24 signals the central control unit 73 in conventional manner and the central control unit 73 controls the regulating valve 57 to cease the flow of compressed gas from the compressed gas source 58 to the jet nozzles 51,52,53. The central control unit 73 also controls the suction device 24 to swing the suction mouth 25 along the circular arc 26 to deliver the engaged yarn end to the splicing device for subsequent continued unwinding of the yarn from the yarn package disposed within the gas guide chamber 50.

Once the yarn on the yarn package supported on the tube support member 38 has been completely unwound, only an empty tube remains on the tube support member 38. In correspondence with the completion of the unwinding of the yarn package, the central control unit 73 controls the first movement means 64 to retract the connector 62 to thereby move the first chamber portion 50*a* from the chamber forming position to a clearance position in which the first chamber portion is cleared from the cross path sufficiently for the tube support member 38 to be conveyed therepast by the cross-transport assembly 32 toward the discharge location. Additionally, the central control unit 73 controls the second movement means 65 to retract the second chamber portion 50*b* from the chamber forming position to its respective clearing position.

Once the second chamber portion 50*b* reaches its respective clearance position, the next following tube support member 39 is moved by the action of the cross-transport assembly 32 in the direction of travel 61 into the unwinding location. In coordination with the movement of the tube support member 39 into the unwinding location, the central control unit 73 controls the first movement means 64 to move the first chamber portion 50*a* from its respective clearance position to a travel blocking position in which the enlarged foot portion 50*a'* sufficiently extends into the cross path at the unwinding location to prevent further travel of the tube support member 39 in the direction of travel 61.

The movement of the first chamber portion 50*a* from its respective clearance position to the travel blocking position is timed in coordination with the movement of the support member 38, which has just exited the unwinding location, such that the tube support member 38 has traveled sufficiently beyond the first chamber portion 50*a* to preclude the movement of the first chamber portion from its clearance position to the travel blocking position from hindering the movement of the tube support member 38 toward the discharge location. Depending upon the operating circumstances, the travel blocking position of the first chamber portion 50*a* may be substantially coincidental with its chamber forming position. In other operating circumstances, the travel blocking position may entail the positioning of the enlarged foot portion 50*a'* only slightly into the cross path but to a sufficient extent to prevent further travel of the next following tube support member 39. Thereafter, the first chamber portion 50*a* is moved to the chamber forming position.

Once the next following tube support member 39 is positioned at the unwinding location in contact with the first chamber portion 50*a*, the central control unit 73 controls the second movement means 65 to move the second chamber portion 50*b* from its respective clearance position to the chamber forming position. During this movement, the second chamber portion 50*b* contacts the tube support member 40, which is now the next following tube support member with respect to the tube support member 39 at the unwinding location, and displaces the tube support member 40 in a direction opposite to the direction of travel 61 as the second chamber portion moves into the chamber forming position. The enlarged foot portion 50*b'* is now interposed between the respective cylindrical base plates 42 of the tube support members 39,40. In correspondence with the movement of the second chamber portion 50*b* into the chamber forming position, the central control unit 73 controls the regulating valve 57 to supply compressed gas to the jet nozzles 51,52,53 to perform a yarn end loosening operation on the yarn package supported by the tube support member 39.

Figure 9:
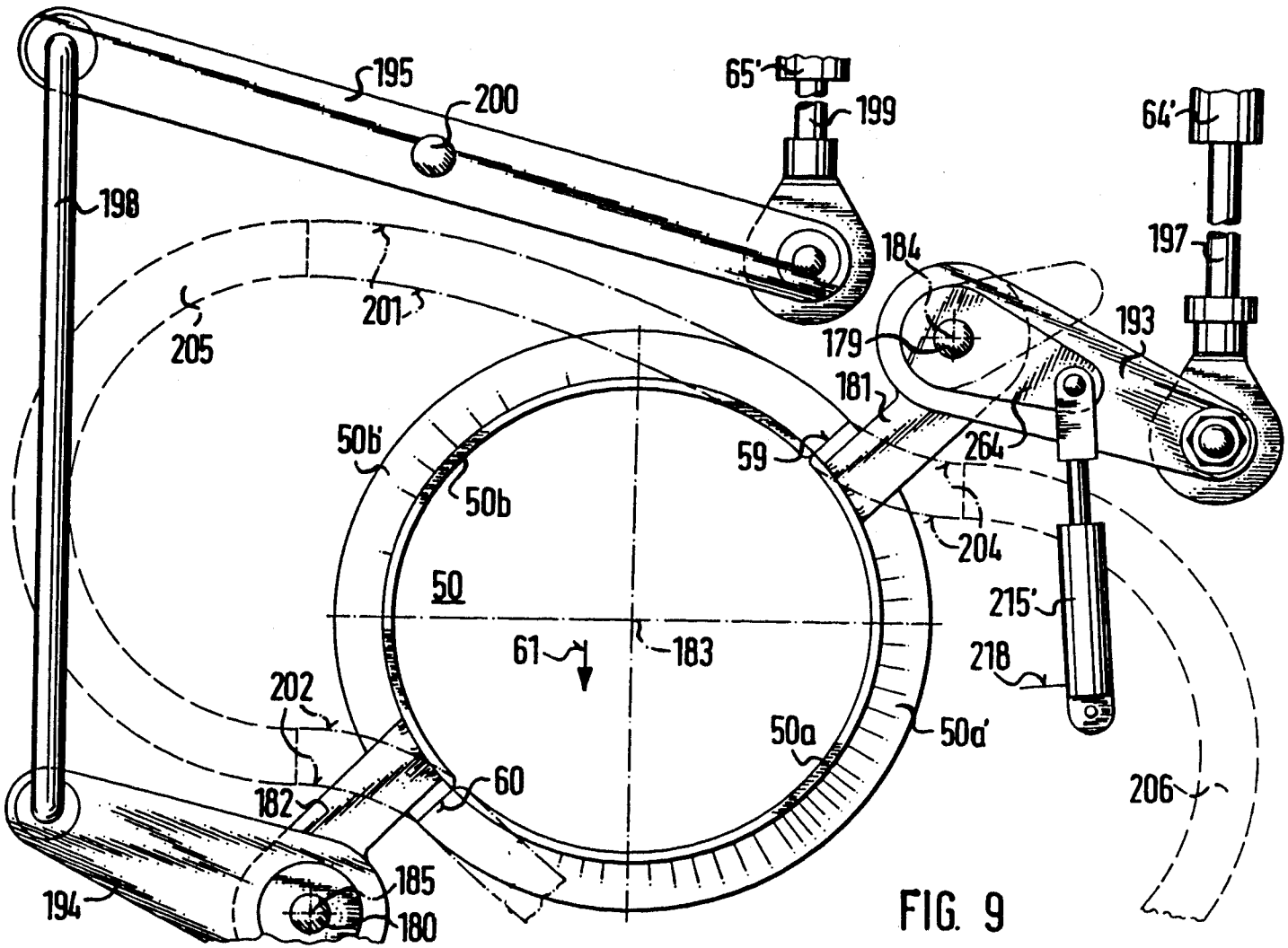
FIG. 9 is a plan view of a portion of a further embodiment of the yarn end loosening apparatus of the present invention.

In FIG. 9, another form of the means for moving the first chamber portion 50*a* and the second chamber portion 50*b* between their respective clearance, travel blocking and chamber forming positions is illustrated.

Figure 6:
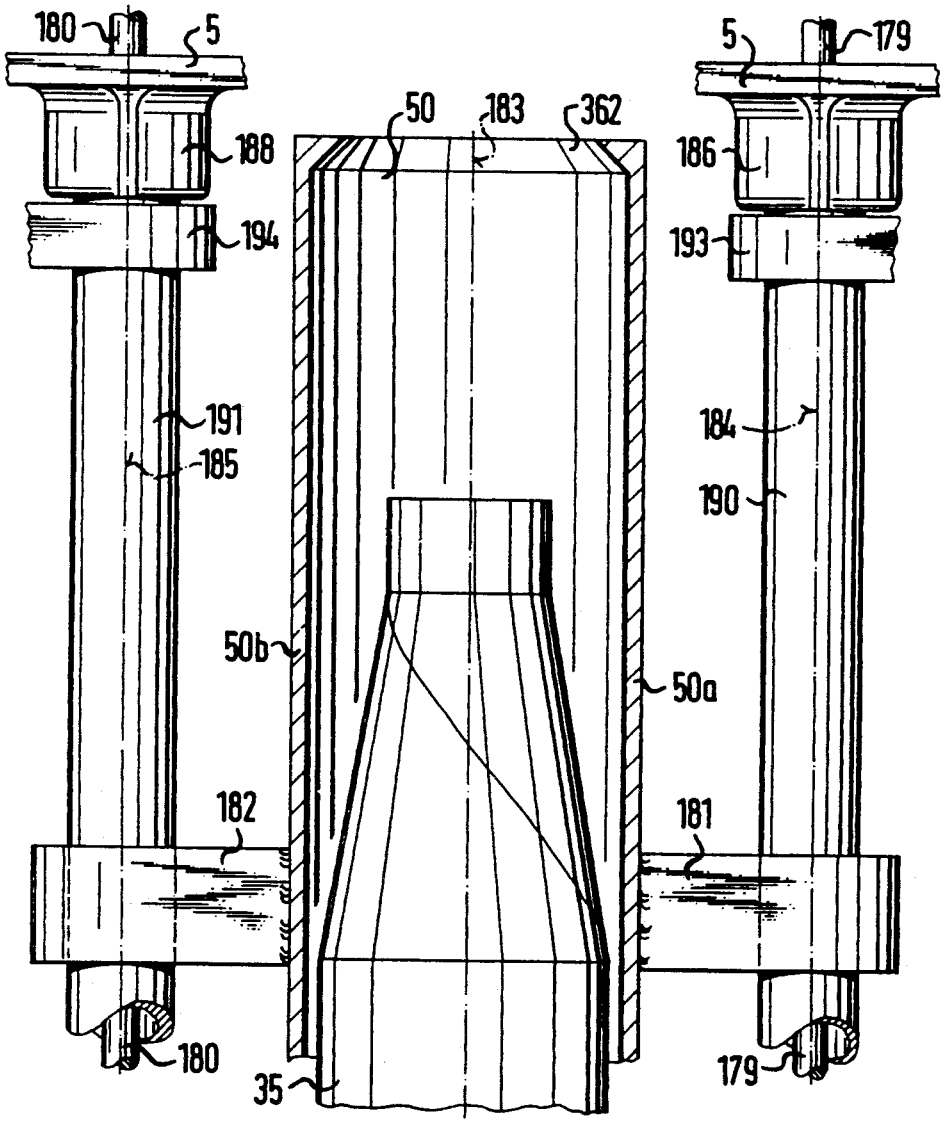
FIG. 6 is a vertical sectional view of a portion of the yarn end loosening apparatus shown in FIG. 1.

The yarn end loosening apparatus 31 illustrated in FIG. 9 is identically configured to the embodiment of the apparatus illustrated in FIG. 1 and 12 except that the first movement means 64, the connector 62, the second movement means 65, the connector 63, the first support post 66 and the second support post 67 are deleted. The yarn end loosening device 31 includes instead a first connector arm 181 fixedly connected to the first chamber portion 50*a* and a second connector arm 182 fixedly connected to the second chamber portion 50*b*, as seen in FIGS. 6 and 9. The first connector arm 181 is fixedly connected to a first cylindrical tube member 190 and the second connector arm 182 is fixedly connected to a second cylindrical tube member 191. The first cylindrical tube member 190 is rotatably supported by a bearing assembly 186 which is fixedly connected to the support frame 5, as shown in FIG. 6. The second cylindrical tube member 191 is rotatably mounted to the support frame 5 by a bearing assembly 188. A first vertical shaft 179 is coaxially mounted in the first cylindrical tube member 190 and a second vertical shaft 180 is coaxially mounted in the second cylindrical tube member 191. A first link member 193 is fixedly connected to the first cylindrical tube member 190 and a second link member 194 is fixedly connected to the second cylindrical tube member 191, as seen in FIG. 6. As seen in FIG. 9, the first link member 193 is pivotally connected to the free end of a first rod 197. The first rod 197 is interconnected to a first piston 64' for selectively retraction and extension of the first rod 197 relative to the first piston 64'.

The second link member 194 is pivotally connected to one end of a connector 198 and the other end of the connector 198 is pivotally connected to one end of a rocker lever 195 that is pivotally connected by a pivot 200 to the support frame 5. The other end of the rocker lever 195 is pivotally connected to the free end of a second rod 199. The second rod 199 is interconnected to a second piston 65' which is operable to selectively retract and extend the second rod 199. The first piston 64' and the second piston 65' are fixedly connected to the support frame 5 by appropriate conventional securement means. Additionally, the first piston 64' and the second piston 65' are operatively connected conventionally to the central control unit 73.

In operation, the first piston 64' and the second piston 65' are selectively controlled by the central control unit 73 to effect movement of the first chamber portion 50*a* and the second chamber portion 50*b* between their respective clearance, travel blocking and chamber forming positions. Specifically, to position the first chamber portion 50*a* in its chamber forming position, as shown in FIG. 9, the first piston 64' extends the first rod 197. The extension of the first rod 197 effects pivoting of the first link member 193 about the axis of the first vertical shaft 179. Since the first link member 193 is fixedly connected to the first cylindrical tube member 190, the first cylindrical tube member 190 rotates about the axis of the first vertical shaft 179 in correspondence with the rotation of the first link member 193 and thereby effects rotation of the first connector arm 181 about the axis of the first vertical shaft 179 in a clockwise direction, as viewed in FIG. 9.

The clockwise rotation of the first connector arm 181 positions the first chamber portion 50*a* in its chamber forming position. In correspondence with the positioning of the first chamber portion 50*a* in its chamber forming position, the next one of the tube support members 38,39 or 40 to be fed to the unwinding location is advanced under the action of the cross-transport assembly 32 into contact with the inner surface of the first chamber portion 50*a*. The central control unit 73 then controls the second piston 65' to extend the second rod 199. The extension of the second rod 199 effects pivoting of the rocker lever 195 about the pivot 200 and the pivoting of the pivot 195 causes, via the connector 198, clockwise pivoting of the second link member 194, as viewed in FIG. 9. The clockwise pivoting of the second link member 194 effects rotation of the second cylindrical tube member 191 in a clockwise direction about the axis of the second shaft 180 and the pivoting of the second cylindrical tube member 191 effects movement of the second chamber portion 50*b* from its respective clearance position 205 to its chamber forming position in which it mates with the first chamber portion 50*a* along the first interface line 59 and the second interface line 60. The respective yarn package which is thus enclosed within the gas guide chamber 50 then undergoes a yarn end loosening operation and a subsequent unwinding operation at the unwinding location.

Once the yarn package has been completely unwound at the unwinding location, the central control unit 73 controls the first piston 64 to retract the first rod 197 to thereby effect, via the first cylindrical tube member 190 and the first connector arm 181, movement of the first chamber portion 50*a* from its chamber forming position to its respective clearance position 206. The respective tube support member 38,39 or 40, which now supports an empty tube at the unwinding location, is then transported by the action of the cross-transport assembly 32 from the unwinding location to the discharge location.

Due to the orientation of the first interface line 59 and the second interface line 60 along a line forming a 45 degree angle with respect to the direction of travel 61, the vertical end portion of the first chamber portion 50*a* which mates with the second chamber portion 50*b* along the first interface line 59 may overlap the cross path to a slight extent, thereby preventing an oncoming tube member from being advanced into the unwinding location. In this regard, the central control unit 73 can be programmed to control the first piston 64' to move the first chamber portion 50*a* from its chamber forming position along a relatively small extent of its travel path 204 toward its respective clearance position 206 by an amount sufficient to move the vertical end portion which would otherwise interfere with the travel of the tube support member, clear of the cross path. Likewise, the vertical end portion of the second chamber portion 50*b* which mates with the first chamber portion 50*a* along the second interface line 60 may extend into the cross path so as to interfere with the movement of a tube support member from the unwinding location toward the discharge location. In this regard, the central control unit 73 can be programmed to control the second piston 65' to effect movement of the second chamber portion 50*b* along its travel path 201,202 toward its clearance position 205 by an amount sufficient to clear the respective vertical end portion of the second chamber portion 50*b* from the cross path.

Following this slight movement of the second chamber portion 50*b*, the respective tube support member can then be transported in an unobstructed manner by the cross-transport assembly 32 from the unwinding location toward the discharge location. At an appropriate time, the central control unit 73 can then fully move the second chamber portion 50*b* to its clearance position 205 to permit the travel of the next following support member into the unwinding location.

In FIGS. 2–5, an alternate embodiment of the yarn end loosening apparatus is illustrated. The alternate yarn end loosening apparatus 31 includes, in lieu of the jet nozzles 51,52 and 53, a lower pair of jet nozzles 330,331, an intermediate pair of jet nozzles 332,333 and an upper pair of jet nozzles 334,335, the respective pairs of jet nozzles each having a predetermined orientation with respect to a horizontal plane 336,337 and 338, respectively. The longitudinal gas conduits 343,344 are selectively communicated with a gas supply conduit 340 by a reversing valve assembly 339, as seen in FIG. 2. The gas supply conduit 340 is communicated with a conventional compressed gas source such as, for example, the compressed gas source 58 illustrated in FIG. 1. The reversing valve assembly 339 includes a slide member 348 and a coupling block 350.

As seen in FIG. 2, each respective pair of jet nozzles forms an angle alpha relative to its respective horizontal plane 336,337 or 338. The angle alpha which the intermediate pair of jet nozzles 332,333 form relative to their respective horizontal plane 337 is greater than the angle which the lower pair of jet nozzles 330,331 form relative to their respective horizontal plane 336. Additionally, the angle formed by the upper pair of jet nozzles 334,335 relative to their respective horizontal plane 338 is greater than the respective angles formed by the intermediate pair of jet nozzles 332,333 and the lower pair of jet nozzles 330,331. As seen in FIG. 3, the individual jet nozzles of each respective pair of nozzles such as, for example, the jet nozzles 334 and 335, direct streams of gas at different tangential directions relative to one another.

The jet nozzles 330–335 are mounted to the second chamber portion 50*b*. A gas conduit housing 342, as seen in FIG. 2, is mounted to the outer surface of the second chamber portion 50*b* and includes a pair of longitudinal gas conduits 343,344 (FIG. 3). The longitudinal conduit 343 is communicated with the respective jet nozzle of the three pairs of jet nozzles which direct a stream of gas in a common tangential direction. The longitudinal gas conduit 344 is connected to the other respective jet nozzle of the pairs of jet nozzles which direct streams of gas in the other tangential direction. The gas conduit housing 342 includes a top portion 345, as seen in FIG. 5 at which the mouths of the longitudinal gas conduits 343,344 are disposed. The top portion 345, as seen in FIG. 5, includes a pair of horizontal guide grooves 346,347. A slide member 348 includes a pair of horizontal flange members, each compatibly configured to engage a respective one of the guide grooves 346,347, to slidably mount the slide member 348 to the top portion 345 for sliding movement of the slide member in a horizontal direction. The slide member 348 additionally includes, as seen in FIG. 2, a throughbore 349.

The gas supply conduit 340 is connected via the coupling block 350 to the throughbore 349 of the slide member 348. As seen in FIG. 5, a conventional means for sliding the slide member 348 relative to the gas conduit housing 342 such as, for example, a conventional electromagnetic drive 361, is operatively connected to the central control unit 73. The central control unit 73 controls the electromagnetic drive 361 to selectively slide the slide member 348 relative to the longitudinal gas conduit housing 342 to selectively communicate the gas supply conduit 340 with a respective one of the longitudinal gas conduits 343,344. Specifically, as seen in FIG. 5, the electromagnetic drive 361 is operable to align the gas supply conduit 340 with the longitudinal gas conduit 344 whereby gas supplied through the gas supply conduit 340 is conducted by the longitudinal gas supply conduit 344 to the respective one jet nozzle of each pair of jet nozzles which directs streams of gas in a common tangential direction. Alternatively, the electromagnetic drive 361 can be controlled to move the slide member 348 relative to the longitudinal gas conduit housing 342 to bring the gas supply conduit 340 into communication with the longitudinal gas bore 343 for supplying gas to the other nozzles to direct the gas in the opposite tangential directions.

In FIGS. 3 and 4, one configuration of the system for supplying gas from the conventional compressed gas source through the gas supply conduit 340 to the reversing valve 339 is illustrated. FIG. 4 shows a vertical section of the system as viewed from the side of the chamber portion 50*b* with the figure of the drawing being disposed vertically. In this system a second cylindrical tube member 191 is provided with a vertically extending conduit 351 communicated at one end with a conventional compressed gas source. As seen in FIGS. 3 and 4, a gas conduit arm 356 is movably coupled via a pair of snap rings 354,355 to the second cylindrical tube member 191 for pivoting about the axis of the cylindrical tube member. The gas conduit arm 356 includes an axial bore 359 which opens into an annular gap 358 formed between the snap rings 354 and 355. The vertical conduit 351 in the second cylindrical tube member 191 is communicated via an interconnecting conduit 357 with the annular gap 358. The interconnecting conduit 357 extends transversely across the second cylindrical tube member 191 for communicating the vertical shaft 351 with another gas conduit arm. However, in the embodiment illustrated in FIGS. 3 and 4, the other portion of the interconnecting conduit 357 is blocked by a plug 360. The other end of the conduit 359 of the gas conduit arm 356 communicates with the gas supply conduit 340. A pair of conventional annular seals 352,353 seal the gas conduit arm 356 with respect to the second cylindrical tube member 191 so that the annular gap 358 experiences relatively little leakage.

As can be understood, compressed gas supplied from the conventional compressed gas source is supplied via the vertical conduit 351, the interconnecting conduit 357, the annular gap 358 and the conduit 359 to the gas supply conduit 340 throughout the range of pivotal movement of the gas conduit arm 356 with respect to the second cylindrical tube member 191. Accordingly, compressed gas is reliably supplied through the gas supply conduit 340 to the longitudinal gas supply conduits 343,344 throughout the range of movement of the second chamber portion 50*b* between its chamber forming position and its clearance position.

Figure 7:
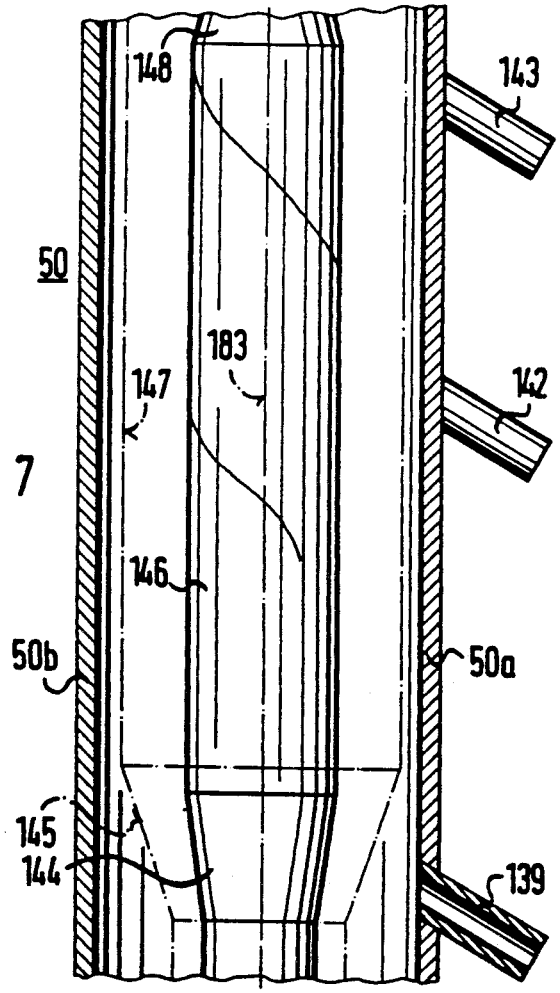
FIG. 7 is a vertical sectional view of another portion of the embodiment of the yarn end loosening apparatus shown in FIG. 1.
Figure 8:
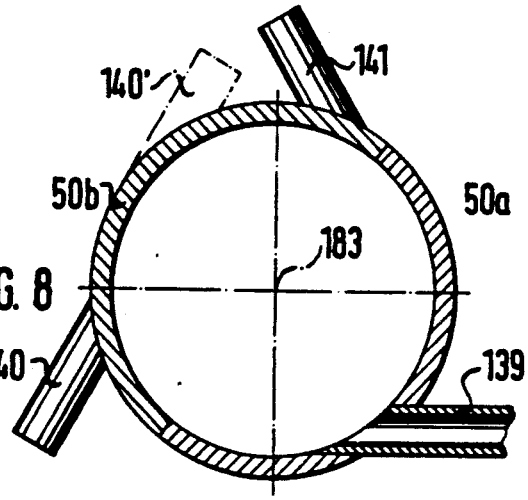
FIG. 8 is a horizontal sectional view of a portion of the embodiment of the yarn end loosening apparatus shown in FIG. 1.

In FIGS. 7 and 8, a variation of the embodiment of the yarn end loosening apparatus 31 discussed with respect to FIG. 1 is illustrated. In lieu of the jet nozzles 51,52,53, three groupings of jet nozzles, each at a different height with respect to the yarn package to be unwound, are provided. Each group of jet nozzles includes two jet nozzles mounted to the second chamber portion 50*b* and one jet nozzle mounted to the first chamber portion 50*a*. For example, as shown in FIG. 8, the lower group of jet nozzles includes a pair of jet nozzles 140,141 mounted to the second chamber portion 50*b* and a jet nozzle 139 mounted to the first chamber portion 50*a*. The jet nozzles 139,140,141 are configured to direct streams of gas in a common tangential direction with respect to the yarn package generally at the vertical level at which the lower tapering portion of the yarn package is located such as, for example, the tapering portion 144 of a yarn package 146 or the tapering portion 145 of a yarn package 147, as shown in FIG. 7.

The intermediate group of jet nozzles, schematically represented by the jet nozzle 142 in FIG. 7, are configured to direct streams of gas generally at the vertical level of the cylindrical body portion of the yarn package 146,147. The upper group of jet nozzles schematically represented by the jet nozzle 143 in FIG. 7, are configured to direct streams of gas generally at the vertical level of the upper tapering portion of the yarn package such as, for example, the upper tapering portion 148 of the yarn package 146. If desired, an additional group of jet nozzles can be disposed above the upper group of jet nozzles schematically represented by the jet nozzle 143 to accommodate relatively large yarn packages. Additionally, as shown in FIG. 8, additional jet nozzles such as, for example, a jet nozzle 140', can be provided to direct streams of gas in tangential direction different than the tangential directions in which the streams of gas are directed by the other groups of jet nozzles. This configuration would provide the gas guide chamber 50 with the capability to loosen the yarn end of yarn packages irrespective of the direction of winding of yarn thereon. Those jet nozzles which direct streams of gas in a tangential direction opposite to the direction of winding of the yarn on the particular yarn package could then be activated to efficiently loosen the yarn end of the yarn package.

The gas guide chamber 50 may have its upper end formed with an upwardly inward taper.

Figure 13:
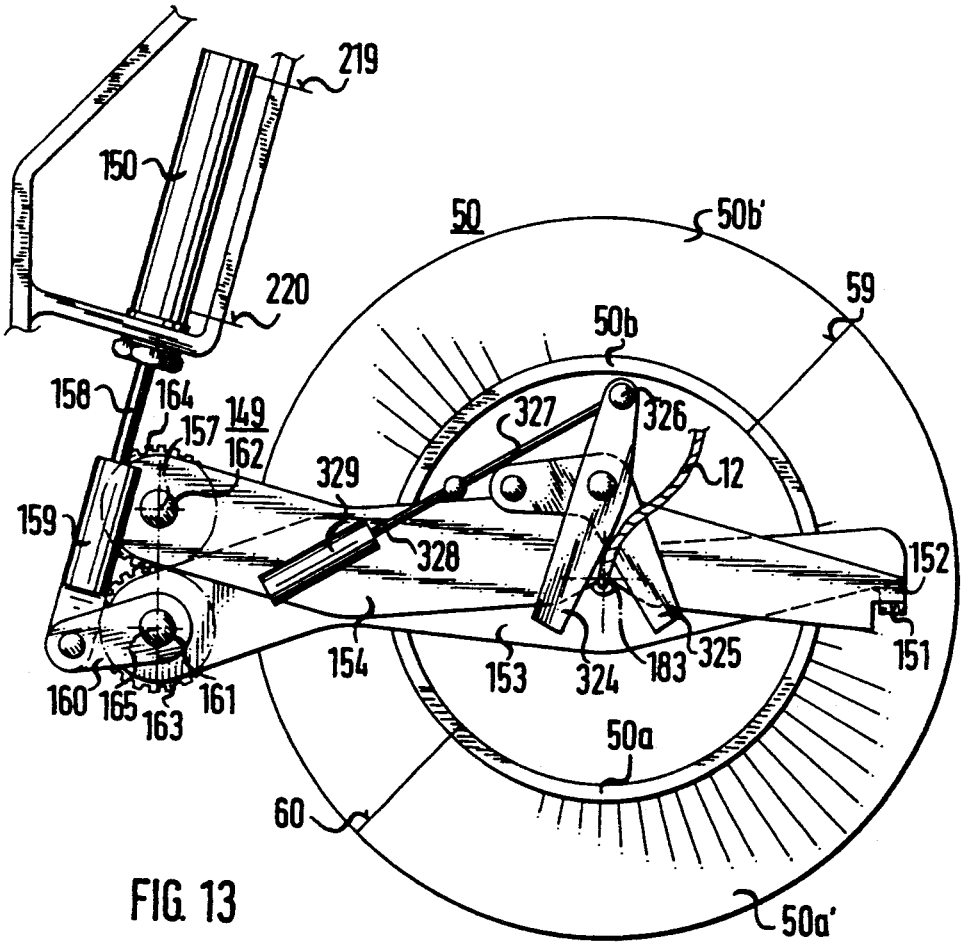
FIG. 13 is a plan view of the yarn loop opening device shown in FIG. 12 in yarn engaging position.

As seen in FIGS. 1, 12, 13 the yarn end loosening apparatus 31 additionally includes a yarn loop opening device 149 having a control device 150 and being mounted to the winding station 2 for engaging the yarn being unwound from a yarn package at the unwinding location as the yarn passes between the gas guide chamber 50 and the suction mouth 25 of the suction device 24. As seen in more detail in FIGS. 12 and 13, the yarn loop opening device 149 includes a first arm 153 and a second arm 154. One end portion of the first arm 153 includes a throughbore for receiving therethrough a vertical shaft 161 fixedly mounted to the support frame 5. The first arm 153 is supported on the vertical shaft 161 by conventional coupling means (not shown) which permit pivoting of the first arm 153 about the axis 165 of the vertical shaft 161. A gear 163 having a central throughbore is coaxially fixedly mounted to the first arm 153. Accordingly, the vertical shaft 161 extends through the respective throughbores of the gear 163 and the first arm 153 for vertical support thereof.

One end portion of the second arm 154 includes a throughbore for receiving therethrough a vertical shaft 162 which is fixedly connected to the support frame 5. A conventional coupling means (not shown) movably couples the second arm 154 to the shaft 162 for permitting pivoting of the second arm 154 about the axis 157 of the shaft 162. A gear 164 having a central throughbore is fixedly mounted to the second arm 154 with the central throughbore of the gear being coaxial with the axis 157 of the shaft 162 for vertical support thereon.

The first arm 153 includes a yarn engagement notch 155 and the second arm 154 includes a yarn engagement notch 156. The first arm 153 includes a contoured surface 153'. The second arm 154 includes a contoured surface 154'. The contoured surfaces 153',154' cooperate together to urge the yarn 12 toward a respective one of the notches 155,156 during the yarn engaging operation of the yarn loop opening device 149, as explained more fully below. As the yarn 12 contacts the first arm 153 and the second arm 154 during its travel therethrough, drag is imparted to the yarn which produces an increased yarn tension in the yarn downstream of the opening. The yarn engagement notches 155,156 are compatibly disposed on their respective arms such that the notches form an opening about the axis 183 of the gas guide chamber 50 for permitting the travel therethrough of yarn being unwound from a yarn package at the unwinding location such as, for example, a yarn 12, as seen in FIG. 13.

The first arm 153 and the second arm 154 extend parallel to one another in a horizontal direction and are vertically offset by a distance sufficient to preclude clamping of a yarn engaged therebetween, as discussed in more detail below. The respective gears 163,164 of the first arm 153 and the second arm 154 are disposed in the same horizontal plane with their teeth in meshing contact with one another for opposite synchronous movement of the arms.

The first arm 153 includes a vertically extending stop member 151 at its free end. The second arm 154 includes a recess 152 at its free end compatibly configured with the stop member 151 to receive the stop member therein when the first arm 153 and the second arm 154 are disposed in the yarn loop opening disposition shown in FIG. 13.

The control device 150 is fixedly mounted to the support frame 5 and to a conventional pneumatic servomotor having a piston rod 158 which is selectively extendable from, and retractable into, a cylinder. The control device 150 is operatively connected via a pair of electrical lines 219,220 to the central control unit 73. A connecting link 159 is fixedly mounted to the free end of the piston rod 158, and the free end of the connecting link 159 is pivotally mounted by a conventional pivot means to one end of a lever 160. The other end of the lever 160 includes a throughbore for receiving the shaft 161 therethrough and the end portion is fixedly connected to the first arm 153.

In operation, the first arm 153 and the second arm 154 are disposed in a non-engagement disposition, as shown in FIG. 12, in which the arms are pivoted away from one another. The pivoting of the arms away from one another occurs as follows. The central control unit 73 controls the control device 150 via the electrical lines 219,220, to retract the piston rod 158 into the cylinder of the pneumatic servomotor. As seen in FIG. 12, the retraction of the piston rod 158 correspondingly moves the connector link 159 in the direction toward the cylinder of the control device 150. The movement of the connector link 159 effects movement of the lever 160 in a clockwise direction. Since the lever 160 is fixedly connected to the first arm 153, the first arm 153 correspondingly rotates about the axis 165 and the gear 163 drives the gear 164 to effect pivoting of the second arm 154 about the axis 157 of the vertical shaft 162 in a direction opposite to the direction of rotation of the first arm 153 about the axis 165.

In its non-engagement disposition as shown in FIG. 12, the yarn loop opening device 149 permits access through the top of the gas guide chamber 50 for a yarn end to exit the gas guide chamber 50 for engagement by the suction mouth 25 of the suction device 24. Once the yarn end has been so engaged and the yarn end has been spliced onto a cross wound package, the central control unit 73 controls the control device 150 to move the first arm 153 and the second arm 154 into the yarn engagement disposition shoWn in FIG. 13 for preventing loops, curls or other yarn irregularities from traveling therebeyond during unwinding of the yarn 12 from the yarn package at the unwinding location. Such loops, curls and other such snarls may occur, for example, if the yarn tension is relatively weak.

The central control unit 73 controls the cylinder of the control device 150 to extend the piston rod 158 outwardly therefrom. The extending movement of the piston rod 158 effects, via the connector link 159, pivoting of the lever 160 in a counterclockwise direction about the axis 165 of the vertical shaft 161, as viewed in FIG. 13. The counterclockwise pivoting of the lever 160 effects counterclockwise pivoting of the first arm 153 and the gear 163 pivots in correspondence with the pivoting of the first arm 153 to drive the other gear 164 to effect pivoting of the second arm 154 about the axis 157 in a clockwise direction counter to the direction of rotation of the first arm 153. Accordingly, the first arm 153 and the second arm 154 pivot toward one another and, eventually, the yarn 12 is engaged by one of the surfaces 153' or 154' and directed toward the associated notch 155 or 156. The stop member 151 of the first arm 153 engages the recess 152 of the second arm 154 to limit pivoting of the first arm 153 and the second arm 154. The yarn 12 is accordingly disposed in the opening formed by the notches 155,156 upon completion of the pivoting of the first arm 153 and the second arm 154. The opening formed by the notches 155,156 is of sufficient extent to permit relatively unobstructed travel of the yarn 12 therethrough but of sufficiently limited extent to cause loops, curls and other types of snarls in the yarn 12 to be eliminated by contact with the first arm 153 and the second arm 154.

The yarn end loosening apparatus 31 additionally includes a yarn cutting assembly, as illustrated in FIGS. 12 and 13. The yarn cutting assembly includes a pivoted shearing arm 324, a fixed shearing arm 325 to which the pivoted shearing arm 324 is pivoted on a pivot post 326, a solenoid 329 fixedly mounted to the second arm 154, a rod 328 selectively extendable from, and retractable into, the solenoid 329 and a connecting link 327. The free end of the connecting link 327 is pivotally connected to one end of the pivoted shearing arm 324 and the other end of the connecting link 327 is connected to the free end of the rod 328. The solenoid 329 is operably controlled conventionally by the central control unit 73.

The pivoted shearing arm 324 and the fixed shearing arm 325 are disposed relative to the notch 156 such that the yarn cutting area defined therebetween is substantially coincidental with the opening defined by the notches 156,155. Accordingly, as shown in FIG. 13, the yarn cutting assembly is disposed in a disposition in which the yarn 12 traveling through the opening defined by the notches 155,156 travels through the cutting area between the pivoted shearing arm 324 and the fixed shearing arm 325. Accordingly, shearing of the yarn 12 is accomplished by retraction of the rod 328 into the solenoid 329 to effect pivoting of the pivoted shearing arm 324 on the pivot post 326 into yarn shearing engagement with the fixed shearing arm 325. The yarn shearing assembly can be activated, for example, to shear any trailing yarn following the completion of a winding operation. Alternatively, the yarn shearing assembly can be activated to prepare a yarn end for disposition on the yarn supply package in a preferred disposition such as, for example, in an upper winding or inserted into the upper open end of the tube of the package.

Figure 11:
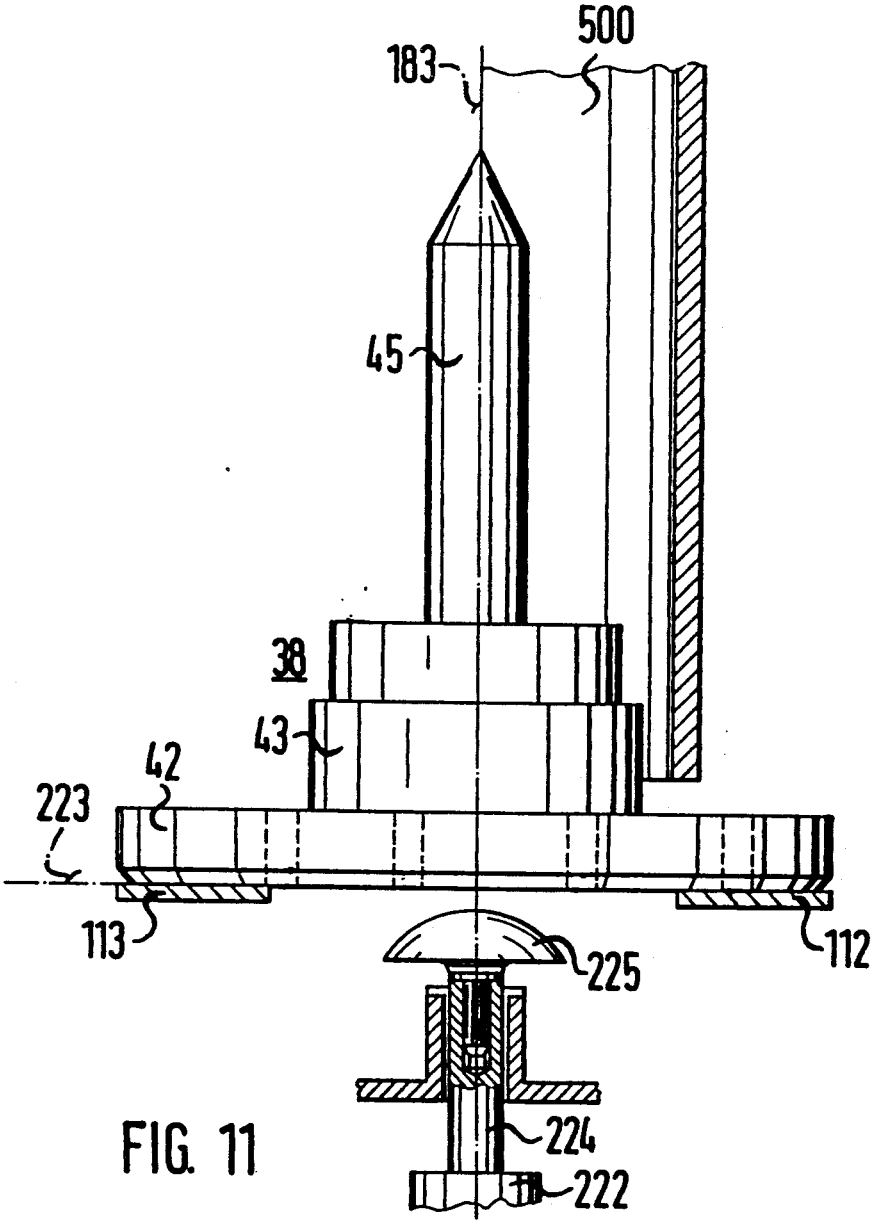
FIG. 11 is a vertical sectional view of a portion of yet an additional embodiment of the yarn end loosening apparatus of the present invention and showing a tube support member and a tilt producing member.

In FIG. 11, an alternate form of the first chamber portion **50*a* and the second chamber portion 50*b* of the embodiment of the yarn end loosening apparatus 31 discussed with respect to FIG. 1 is illustrated. In lieu of the first chamber portion 50*a* and the second chamber portion 50*b*, two chamber portions 500 are provided, only one of which is illustrated in FIG. 11. Each chamber portion 500 is formed as one longitudinal half of a cylinder. The chamber portions 500 form a gas guide chamber with a diameter greater than the diameter of the intermediate plate 43 of a respective tube support member such as, for example, the tube support member 38 yet smaller than the diameter of the cylindrical base plate 42 of the tube support member. Accordingly, the chamber portions 500 are disposed sufficiently above the support plane 223 of the cross-transport assembly 32 on which the tube support members are supported to permit the cylindrical base plates 42 of the tube support members to pass underneath the chamber portions. Positioning of a tube member at the unwinding location can be accomplished through movement of the tube support member into the unwinding location until its intermediate cylindrical plate 43 contacts the respective chamber portion 500**.

Figure 10:
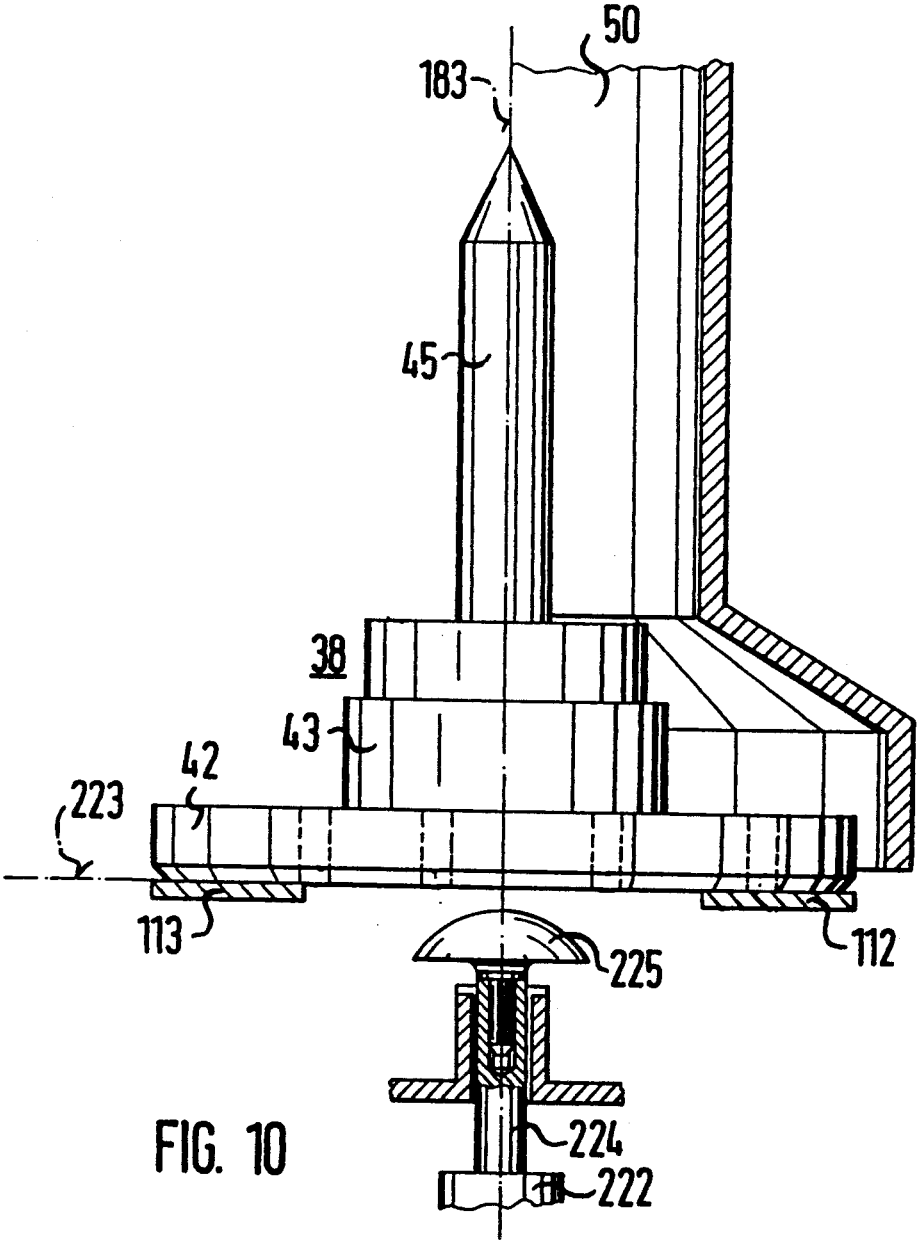
FIG. 10 is a vertical sectional view of a portion of the embodiment of the yarn end loosening apparatus shown in FIG. 1 and showing a tube support member and a tilt producing device.

As seen in FIGS. 10 and 11, the tube support member conveying apparatus additionally includes a tilt assembly for facilitating the loosening of a yarn end of a yarn package at an unwinding location. As seen in FIG. 10, the tilt assembly includes a conventional pneumatic cylinder and piston assembly having a piston rod 224 movably received in a cylinder 222, the assembly being operable to extend and retract its piston vertically, and a nonplanar convex contact member 225 in the form of an inverted spherical segment fixedly mounted to the free end of the piston rod 224. The cylinder 222 of the pneumatic cylinder and piston assembly is fixedly connected to the support frame 5 by conventional securement means (not shown). The axis of the piston rod 224 is aligned with the axis 183 of the gas guide chamber 50 at the unwinding location.

The tilt assembly is operatively connected to the central control unit 73 and is operable to selectively extend the contact member 225 through the opening located between the endless belts 112, 113 into contact with a respective tube support member at the unwinding location to effect movement of the tube on the respective tube support member between its initial supported position in which the tube axis is perpendicular to the support plane 223 and an offset position in which the tube axis is at an acute angle with respect to the support plane 223. Specifically, the tilt assembly is operable to selectively vertically extend the contact member 225 from a position vertically below the support plane 223 at the unwinding location to a position in which the contact member 225 is vertically extended into engagement with the bottom surface of the tube support member to thereby lift and tilt the tube support member.

As the center of the tube support member is raised, a portion of the base cylindrical plate 42 of the tube support member in contact with one of the endless belts 112,113 remains in contact with the respective endless belt while the other portion of the base cylindrical plate 42 previously in contact with the other of the endless belts 112,113 is raised from the other endless belt. This movement effects tilting of the axis of the upright component 45 relative to the axis 183 of the gas guide chamber 50 and, accordingly, tilting of the yarn package supported on the upright component 45. Thus, a yarn package such as, for example, the yarn package 35, which is supported on the tube within the unwinding location, is moved into leaning disposition with the inner surface of the gas guide chamber 50.

Since the yarn package is in leaning disposition against the inner surface of the gas guide chamber 500, the yarn package is be subjected to relative movement along the inner surface upon the introduction of streams of gas thereagainst such as, for example, upon the introduction of streams of gas through the jet nozzles 51,52 and 53. The movement of the yarn package relatively along the inner surface of the gas guide chamber 50 facilitates the loosening of the yarn end. At the completion of the unwinding of the yarn end, the yarn end has traveled upwardly beyond the gas guide chamber 50 to be engaged by the suction tube 24, whereupon the central control unit 73 controls the pneumatic cylinder and piston rod assembly to retract its piston rod to lower the contact member 225 to its non-engaged position below the level of the plane 223.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a plurality of independently movable tube support members for individually supporting tubes in generally upright dispositions, an unwinding device for unwinding, at an upwinding location, packages of textile material such as yarn or the like which is wound on tubes supported on the tube support members, a delivery assembly for delivering the tube support members to a preliminary location for feeding to the unwinding device, a discharge assembly for transporting tube support members from a discharge location to a further handling location, and a cross-transport assembly for transporting the tube support members along a cross path extending from the preliminary location through the winding location to the discharge location, a yarn end loosening apparatus, comprising:

a first chamber portion;

a second chamber portion, said first and second chamber portions being positionable to combine to form a gas guide chamber and at least one of said first and second chamber portions having jet nozzles for directing jet streams of gas into the chamber against a yarn package therein to loosen a yarn end thereof;

first movement means connected to said first chamber portion for selectively moving said first chamber portion between a chamber forming position at the unwinding location in which said first chamber portion and said second chamber portion form said gas guide chamber for guiding gas relative to a yarn package supported by a respective tube support member at said unwinding location, a clearance position for permitting the respective tube support member to be moved from the unwinding location by the cross-transport assembly and a travel blocking position to block travel of the tube support member following the respective tube support member beyond the unwinding location; and second movement means connected to said second chamber portion for selectively moving said second chamber portion between said chamber forming position and a clearance position spaced from the cross path for permitting travel of a tube support member therepast along the cross path.

2. In a textile machine, a yarn end loosening apparatus according to claim 1 and characterized further in that said second movement means moves said second chamber portion from its respective clearance position to said chamber forming position in correspondence with the movement of the following tube support member to the unwinding location to separate the following tube support member from a subsequently following tube support member.

3. In a textile machine, a yarn end loosening apparatus according to claim 2 and characterized further in that said first movement means includes a first vertical shaft and means for pivotally coupling said first chamber portion to said first vertical shaft for pivoting thereabout, said second movement means includes a second vertical shaft and means for pivotally coupling said second chamber portion to said second vertical shaft for pivoting thereabout and means for pivoting said first and second chamber portions about said respective vertical shafts.

4. In a textile machine, a yarn end loosening apparatus according to claim 3 and characterized further in that said pivoting means includes a first link member connected to said first chamber portion, a second link member connected to said second chamber portion and link drive means for driving said first and second link members.

5. In a textile machine, a yarn end loosening apparatus according to claim 1 and characterized further in that said jet nozzles comprise a plurality of jet nozzles for directing jet streams of gas interiorly of the gas guide chamber in inclined tangential directions with respect to a package supported by the respective tube support member at the unwinding location toward an end of the package to thereby loosen the end of the package.

6. In a textile machine, a yarn end loosening apparatus according to claim 5 and characterized further by valve means for regulating the supply of gas to said jet nozzles.

7. In a textile machine, a yarn end loosening apparatus according to claim 5 and characterized further in that said jet nozzles comprise a first group of at least three jet nozzles axially displaced from one another, each jet nozzle being inclined at successively greater inclinations from the lowermost jet nozzle to the uppermost jet nozzle.

8. In a textile machine, a yarn end loosening apparatus according to claim 7 and characterized further in that said jet nozzles are mounted in a selected one of said first and second chamber portions.

9. In a textile machine, a yarn end loosening apparatus according to claim 8 and characterized further in that said jet nozzles are vertically aligned with one another.

10. In a textile machine, a yarn end loosening apparatus according to claim 7 and characterized further in that said jet nozzles include a second group of at least three jet nozzles, said jet nozzles of said first group direct jet streams of gas in a common first tangential direction and said jet nozzles of said second group direct jet streams of gas in a common second tangential direction different than said first common tangential direction.

11. In a textile machine, a yarn end loosening apparatus according to claim 10 and characterized further by a reversing valve means for communicating a selected one of said first and second group of jet nozzles to a source of compressed gas.

12. In a textile machine, a yarn end loosening apparatus according to claim 11 and characterized further in that said first and second group of jet nozzles and said reversing valve member are mounted on a selected one of said first and second chamber portions.

13. In a textile machine, a yarn end loosening apparatus according to claim 1 and characterized further in that said gas guide chamber has an upper end formed with an upwardly inward taper.

* * * * *